US008141868B1

(12) United States Patent
Wang et al.

(10) Patent No.: US 8,141,868 B1
(45) Date of Patent: Mar. 27, 2012

(54) SHEET GUIDING APPARATUS

(75) Inventors: Kuo-Hsien Wang, Taipei (TW); Yung-Kai Chen, Taipei (TW); Pei-Chun Lu, Taipei (TW)

(73) Assignee: Foxlink Image Technology Co., Ltd., Taipei (TW)

( * ) Notice: Subject to any disclaimer, the term of this patent is extended or adjusted under 35 U.S.C. 154(b) by 0 days.

(21) Appl. No.: 13/027,535

(22) Filed: Feb. 15, 2011

(51) Int. Cl.
*B65H 9/06* (2006.01)
*B65H 1/00* (2006.01)

(52) U.S. Cl. ..... 271/171; 271/241; 271/248

(58) Field of Classification Search ..... 271/171, 271/241, 248; 399/389, 370; 400/633, 633.2
See application file for complete search history.

(56) References Cited

U.S. PATENT DOCUMENTS 7,618,038 B2 * 11/2009 Aida ..... 271/162
7,967,288 B2 * 6/2011 Nishinakama ..... 271/171
2006/0091599 A1 * 5/2006 Okuda et al. ..... 271/248
2010/0148427 A1 * 6/2010 Shimazu et al. ..... 271/171
2011/0163495 A1 * 7/2011 Aoyama et al. ..... 271/241

* cited by examiner

*Primary Examiner* — Kaitlin Joerger
(74) *Attorney, Agent, or Firm* — WPAT, P.C.; Anthony King

(57) ABSTRACT

A sheet guiding apparatus assembled on a shelf includes two guiding members, two adjusting plates, a first spring, two push bars, a second spring and two rotating members. The guiding member has a base board. A front of the base board defines a guiding portion defining a horizontal recess. Each adjusting plate is pivoted to an outside edge of the base board. The push bars are movably received in the horizontal recesses and capable of sliding in the horizontal recesses to drive the corresponding adjusting plates to rotate upward or free the corresponding adjusting plates therefrom. Each rotating member is pivoted to a front of the guiding portion. When the rotating member is turned down, the rotating member touches the push bar and pushes the push bar to move rearward so that further drives the adjusting plate to rotate upward till being perpendicular to the base board.

10 Claims, 5 Drawing Sheets

SHEET GUIDING APPARATUS

BACKGROUND OF THE INVENTION

1. Field of the Invention

The present invention relates to a sheet guiding apparatus, and more particularly to a sheet guiding apparatus capable of adjusting a guiding area to sheets.

2. The Related Art

A sheet guiding apparatus is often used in many electrical devices, such as printer, scanner and fax machine, for adjusting the sheets when the sheets are feed, and preventing the sheets being stuck because of skewing. The guiding area for the sheets in the sheet guiding apparatus is the most important fact for assuring the performance of the sheet guiding apparatus. As the size of the electrical device becoming smaller and smaller, the sheet guiding apparatus should be improved to agree with the size of the electrical device. However, the conventional sheet guiding apparatus generally has a fixed guiding area and cannot be adjusted so that result in a lot of space taken up by the sheet guiding apparatus and can not meet the demand of the miniaturization and different size of sheets.

SUMMARY OF THE INVENTION

Accordingly, an object of the present invention is to provide a sheet guiding apparatus assembled on a shelf. The sheet guiding apparatus includes a pair of guiding members, a pair of adjusting plates, a first spring, a pair of push bars, a second spring and a pair of rotating members. The guiding members are movably mounted to two opposite ends of the shelf and capable of moving toward and away from each other to adjust a distance therebetween. The guiding member has a base board. A front portion of an outside edge of the base board extends upward to form a guiding portion. The guiding portion has a bottom thereof defining a horizontal recess extending along a front-to-rear direction to penetrate through the guiding portion. A hooking portion is protruded in a front of the horizontal recess. Each of the adjusting plates is pivoted to a rear portion of the outside edge of the base board of one guiding member beside the guiding portion. The adjusting plate is capable of turning up and down. The first spring is mounted between the adjusting plate and the base board. The first spring applies a resetting force on the adjusting plate when the adjusting plate is turned up. The push bars are movably received in the horizontal recesses of the guiding members respectively and capable of sliding in the respective horizontal recesses along the front-to-rear direction so as to drive the corresponding adjusting plates to rotate upward or free the corresponding adjusting plates therefrom. The second spring has one end hooked to a front of the push bar and the other end fastened to the hooking portion. The second spring applies a pulling force on the push bar when the push bar is pushed rearward. Each of the rotating members is pivoted to a front of the guiding portion of one guiding member and capable of turning up and down. When the rotating member is turned down, a rear of the rotating member touches a front end of the push bar and pushes the push bar to move rearward so that further drives the adjusting plate to rotate upward till being perpendicular to the base board.

As described above, when the rotating member is rotated down, the rotating member pushes the push bar rearward. The push bar squeezes the adjusting plate and raises the adjusting plate upward. As a result, the guiding area for the sheets is enlarged. The rotating member also can be raised up. As the rotating member does not push the push bar any more, the push bar moves forward to free the adjusting plate so that the adjusting plate rotates downward to be level with the base board. As a result, the size of the sheet guiding apparatus is reduced. So, the adjusting plate can be raised up to increase the guiding area, and also can be put down to reduce the size of the sheet guiding apparatus.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
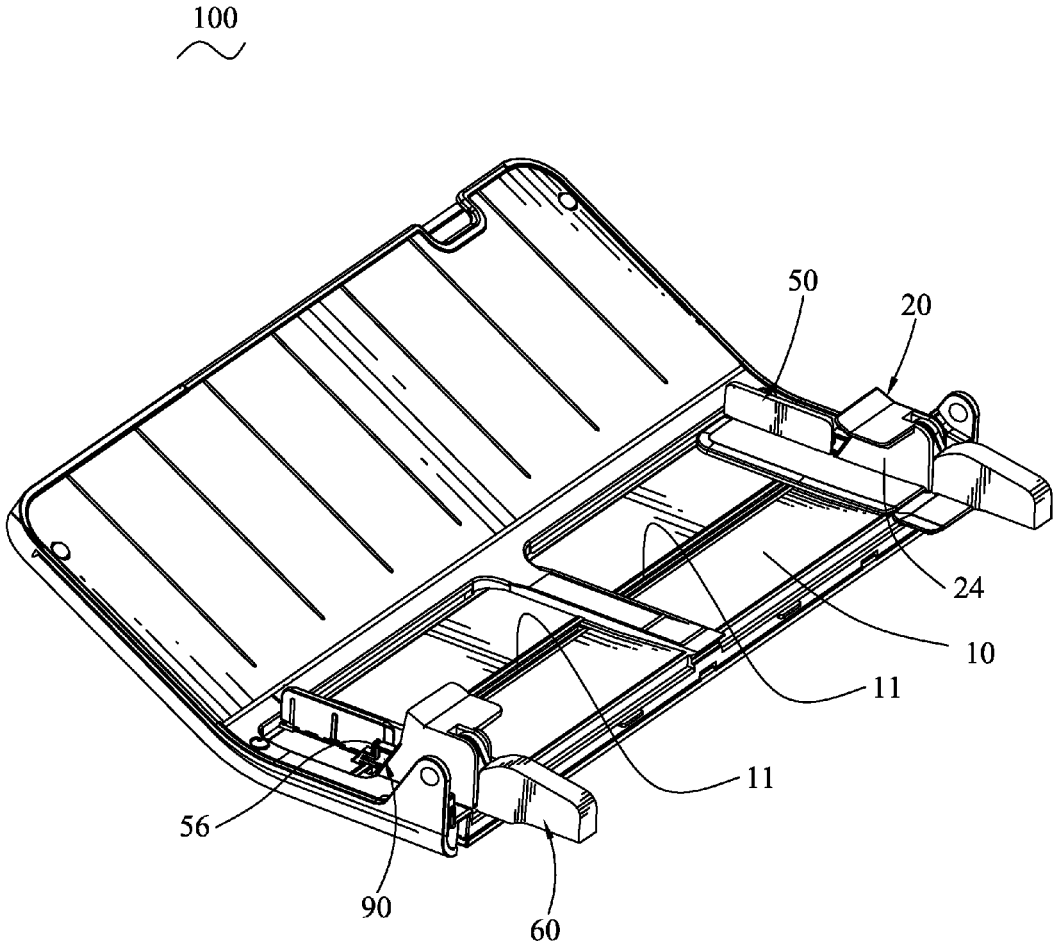
FIG. 1 is an assembled, perspective view of a sheet guiding apparatus of an embodiment in accordance with the present invention.
Figure 2:
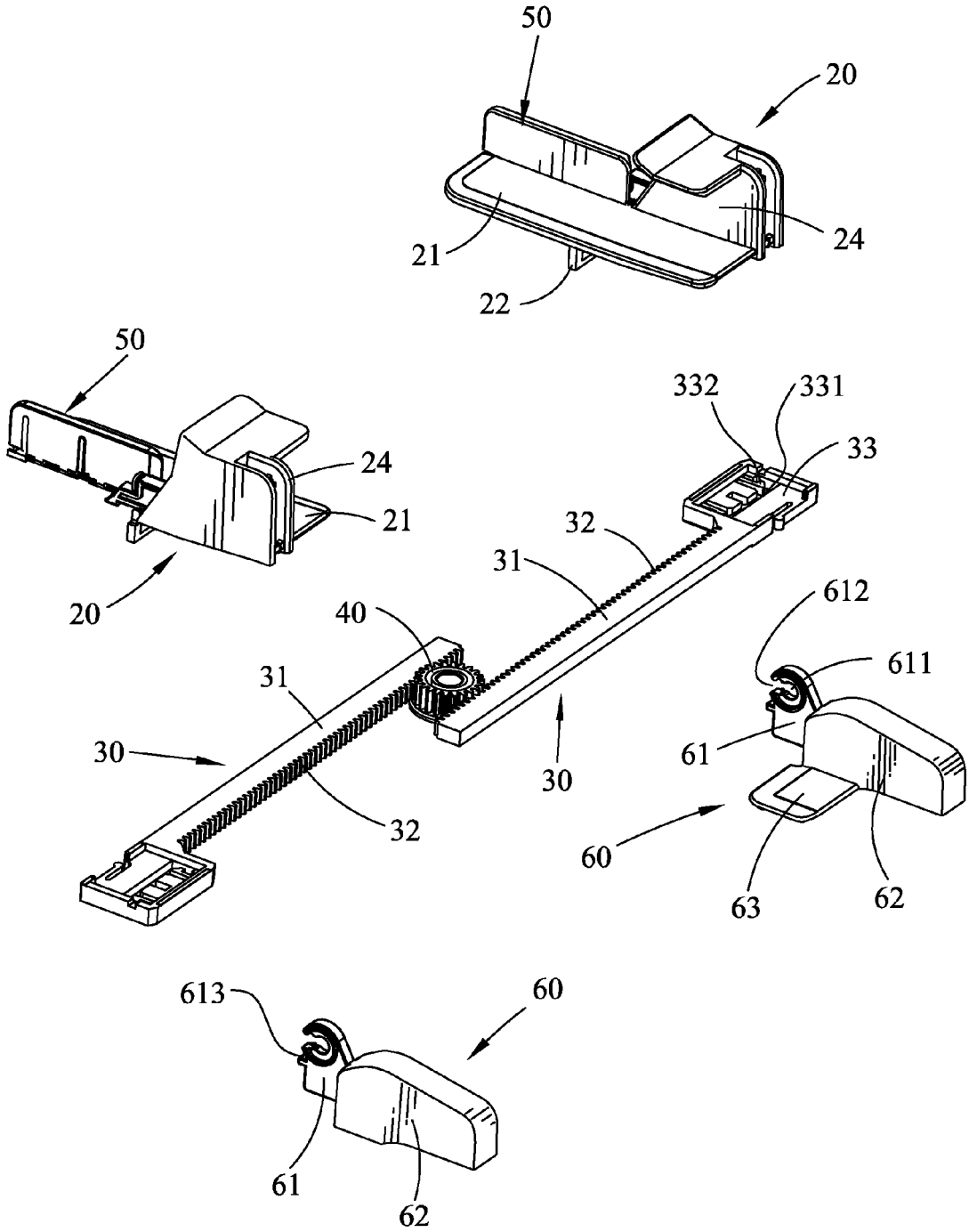
FIG. 2 is an exploded, perspective view of the sheet guiding apparatus shown in FIG. 1.

Referring to the drawings in greater detail, and first to FIGS. 1-2, the embodiment of the invention is embodied in a sheet guiding apparatus 100. The sheet guiding apparatus 100 includes a shelf 10, a pair of guiding members 20 movably assembled to two opposite ends of the shelf 10, a pair of adjusting plates 50 mounted to a rear of the corresponding guiding members 20, a pair of push bars 90 mounted to a bottom of the guiding members 20 respectively, and a pair of rotating members 60 respectively mounted to the guiding members 20 for pushing the corresponding push bars 90 moving rearward when the rotating members 60 are rotated forward.

With reference to FIGS. 1-2, the shelf 10 is divided into two parts each defining a guiding slot 11 extending horizontally from a middle of the shelf 10 to an edge of the shelf 10. The two guiding slots 11 are in alignment with each other and perpendicular to the front-to-rear direction of the sheet guiding apparatus 100. A gear 40 is assembled to a middle of a bottom of the shelf 10 and locates between the two guiding slots 11. The sheet guiding apparatus 100 further includes two racks 30 of which each has a strip 31 of long rectangular shape. The two racks 30 are assembled to two opposite sides of the gear 40 and parallel with the guiding slots 11. The strip 31 has one side edge provided with a plurality of teeth 32 for engaging with the gear 40 so that the racks 30 can be driven to relatively move under the cooperation of the gear 40 and the teeth 32. In other words, when one of the racks 30 is pushed toward the middle of the shelf 10, the other rack 30 moves towards a direction opposite to the movement direction of the one rack 30 under the drive of the gear 40. One end of the strip 31 far away from the gear 40 is designed with a rectangular linking portion 33 having a part thereof projecting beyond the side edge of the strip 31 where the teeth 32 are located. The part of the linking portion 33 projecting beyond the side edge of the strip 31 defines a rectangular opening 331. A lateral side of the opening 331 protrudes into the opening 331 to form a pair of buckling portions 332 spaced from each other.

Figure 3:
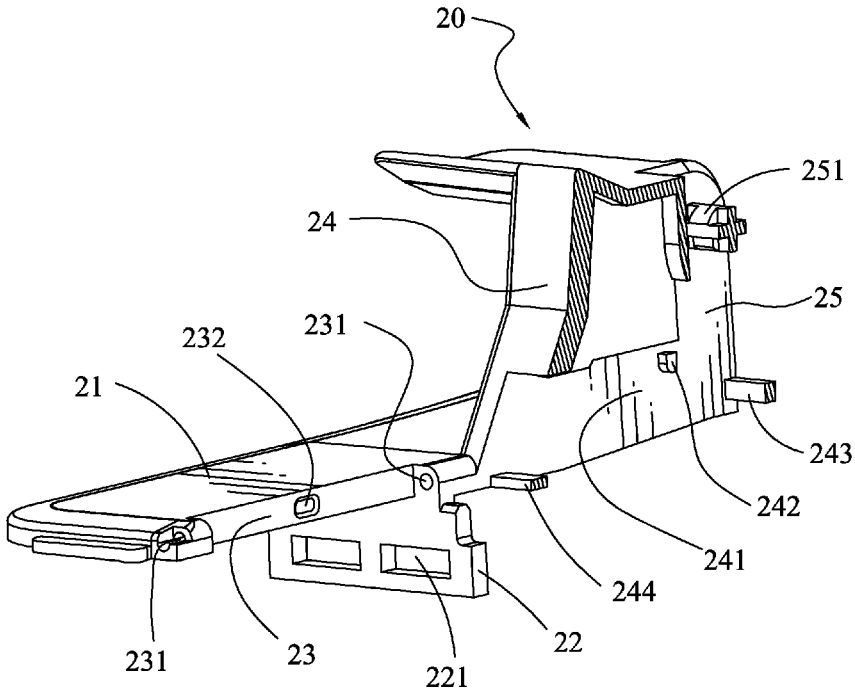
FIG. 3 is a sectional view of a guiding member of the sheet guiding apparatus shown in FIG. 2.
Figure 4:
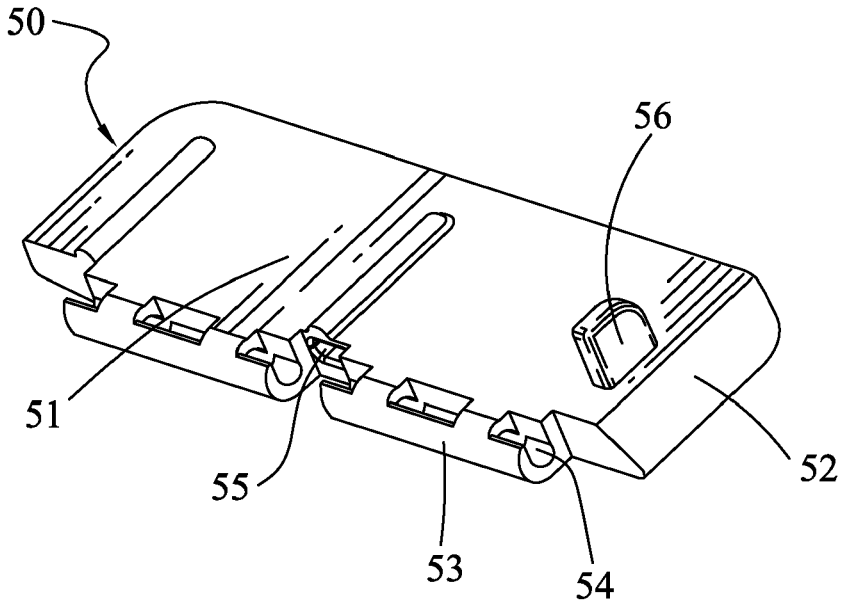
FIG. 4 is a perspective view of an adjusting plate of the sheet guiding apparatus shown in FIG. 2.

Referring to FIGS. 2-3, the guiding member 20 has a base board 21. A middle of a bottom of the base board 21 extends downward to form a fixing portion 22 of rectangular board shape located along a crosswise direction of the base board 21. The fixing portion 22 defines two receiving openings 221 spaced from each other along the located direction of the fixing portion 22. The base board 21 has a front of a lateral side edge connected with a guiding portion 24 perpendicular to the base board 21. A bottom of the guiding portion 24 defines a horizontal recess 241 opposite to the base board 21 and extending frontward and rearwards to pass through the guiding portion 24. A front of the guiding portion 24 is recessed rearward to form a vertical recess 25 opened in the same side of the guiding portion 24 as the horizontal recess 241 and further passing through a top of the guiding portion 24. The vertical recess 25 has a bottom connected with a front of the horizontal recess 241. A supporting portion 244 is protruded at a bottom of a rear of an inside of the horizontal recess 241, a hooking portion 243 is protruded at the front of the inside of the horizontal recess 241 and located at a higher position than the supporting portion 244, and a guiding block 242 is provided at a top of the inside of the horizontal recess 241 and adjacent to the vertical recess 25. An upper portion of an inside of the vertical recess 25 protrudes towards the same direction as the protrusion direction of the hooking portion 243 to form a hinge shaft 251. A rear of the lateral side edge of the base board 21 is recessed inward to form a receiving space 23 of long rectangular shape extending along the lateral side edge of the base board 21 and further passing through a top and a bottom of the base board 21. A pair of through holes 231 is opened at two opposite end sides of the receiving space 23 and each extends along the extension direction of the receiving space 23. The through holes 231 communicate with the receiving space 23 and coaxially face to each other. A first receiving hole 232 is formed at the lateral side of the base board 21 and communicates with a substantial middle of the receiving space 23.

In assembly, the guiding members 20 are movably assembled to the two opposite ends of the shelf 10 with the fixing portions 22 inserted in the corresponding guiding slots 11. The buckling portions 332 of each of the racks 30 are buckled with the corresponding receiving openings 221. So, the distance between the guiding members 20 can be adjusted to different size of papers, by means of the guiding members 20 moving towards or away from each other along the guiding slots 11 under the drive of the racks 30 and the gear 40.

Please refer to FIGS. 2-4 and FIGS. 6-7, the adjusting plate 50 has a rectangular base plate 51. A lateral side edge of the base plate 51 protrudes sideward to form a pair of assembling parts 53 located apart from each other and symmetrically to a middle of the base plate 51. The assembling part 53 defines an assembling hole 54 passing through the whole assembling part 53 along a front-to-rear direction, wherein the assembling holes 54 of the assembling parts 53 face to each other and are coaxial with each other. A portion of the side edge of the base plate 51 between the two assembling parts 53 is recessed inward to form a second receiving hole 55 perpendicular to the assembling hole 54. A front end of a bottom side of the base plate 51 is provided with a guiding plane 52 slanted from top to bottom. A portion of the bottom side of the base plate 51 protrudes downward to form a stopping portion 56 adjacent to the guiding plane 52.

The adjusting plate 50 is pivoted to the rear of the lateral side of the guiding member 20 by the assembling parts 53 received in the receiving space 23 with the through holes 231 being coaxial with the assembling holes 54. A first spring 70 is assembled between the assembling parts 53 with one end fastened in the first receiving hole 232 and the other end fastened in the second receiving hole 55. A shaft 100 passes through the through holes 231, the assembling holes 54 and the first spring 70 for pivoting the adjusting plate 50 to the guiding member 20. Under the action of the first spring 70, the base plate 51 is in a plane with the base board 21 in an initial state and has the front end thereof where the guiding plane 52 is formed near to the guiding portion 24, and the stopping portion 56 is received in the guiding slot 11.

Figure 5:
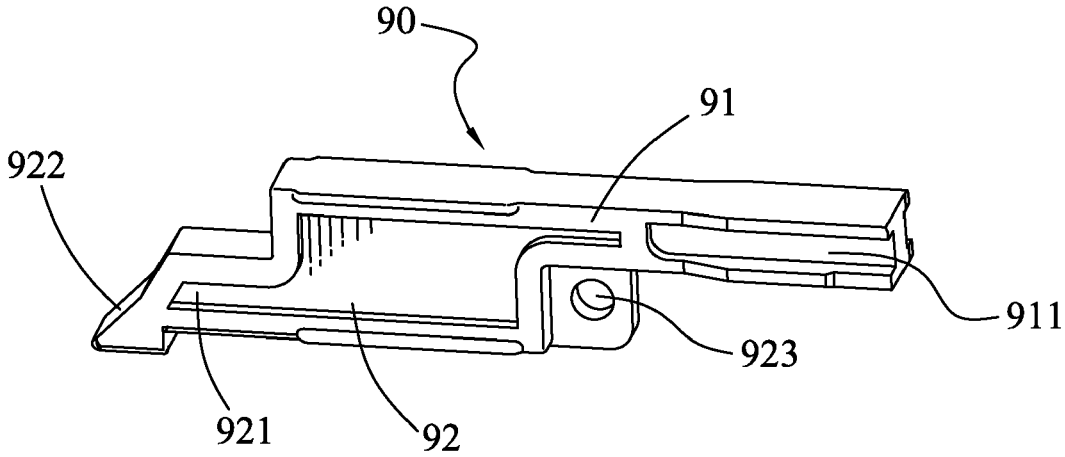
FIG. 5 is a perspective view of a push bar of the sheet guiding apparatus shown in FIG. 2.
Figure 6:
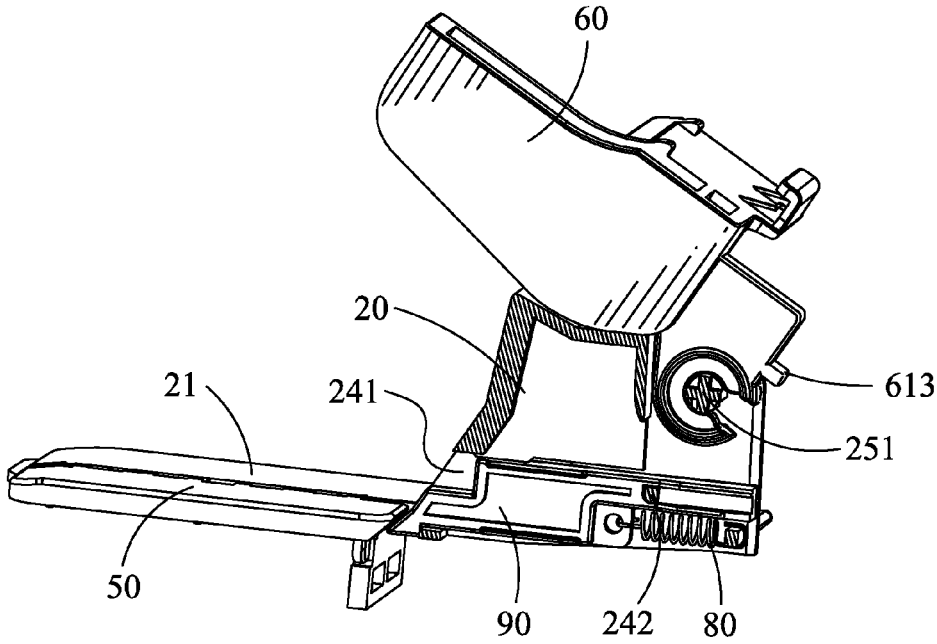
FIG. 6 is a sectional perspective view showing an initiate state of the sheet guiding apparatus.
Figure 7:
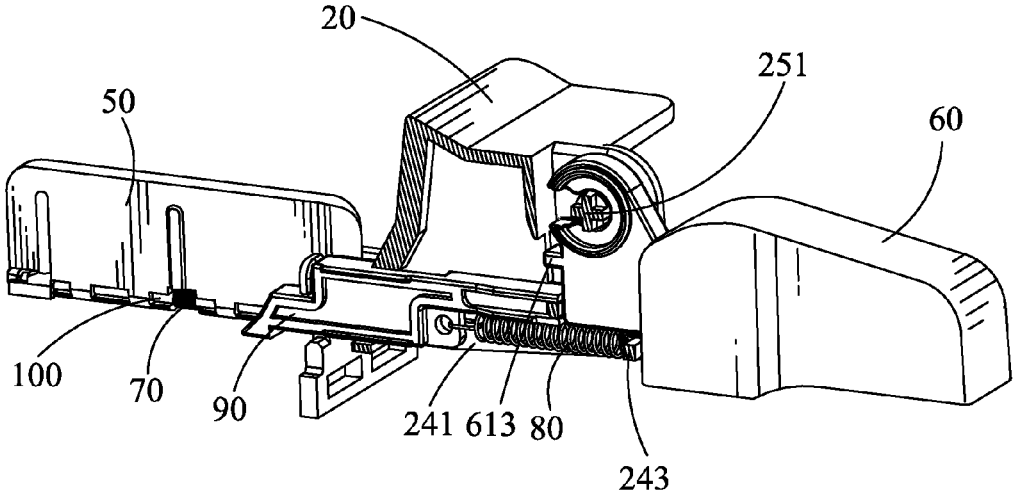
FIG. 7 is a sectional perspective view showing another use state of the sheet guiding apparatus.

Referring to FIGS. 5-7, the push bar 90 has a long rectangular base portion 91. A front of the base portion 91 has a lateral side recessed inward to form a sliding recess 911 extending along the front-to-rear direction with an open front end. A bottom of a rear of the base portion 91 extends downward to form an auxiliary portion 92. The auxiliary portion 92 has a front portion formed with a hooking hole 923. A rear of the auxiliary portion 92 protrudes rearward to form a protrusion 921 extending beyond the rear of the base portion 91. A rear end of the protrusion 921 defines an inclined plane 922 slanting from bottom to top.

The push bar 90 is inserted forward into the horizontal recess 241 and restrained between a top side of the horizontal recess 241 and the supporting portion 244. The guiding block 242 is received in the sliding recess 911 and slides along the sliding recess 911 when the push bar 90 moves in the horizontal recess 241. A second spring 80 is assembled between the auxiliary portion 92 and the hooking portion 243 of the guiding member 20 with one end hooked in the hooking hole 923 and the other end fastened to the hooking portion 243. Under the initial state of the sheet guiding apparatus 100, the guiding plane 52 of the adjusting plate 50 resists against the inclined plane 922 of the push bar 90.

Referring to FIG. 2 and FIGS. 6-7, the rotating member 60 has a hinge portion 61 of plate shape. A top of the hinge portion 61 defines a hinge hole 611. A gap 612 is formed at a rear of the top of the hinge portion 61 and communicates with the hinge hole 611. The rear of a lower part of the hinge portion 61 protrudes rearward to form a resisting block 613. A front of the hinge portion 61 is connected with a handle 62. A bottom of a lateral side of the handle 62 extends sideward to form an extending plate 63.

The rotating member 60 is rotatably assembled to the guiding member 20 by the hinge shaft 251 inserted in the hinge hole 611 of the hinge portion 61 through the gap 612. When the handle 62 is rotated down, a bottom portion of the rear of the hinge portion 61 touches the front of the push bar 90 and further pushes the push bar 90 to move rearward until the resisting block 613 resists against a rear side of the vertical recess 25. At this time, the extending plate 63 is located in front of the base board 21 of the guiding member 20 and in a plane with the base board 21.

FIGS. 6-7 describe the working process of the sheet guiding apparatus 100. FIG. 6 shows the initiate state of the sheet guiding apparatus 100. The rotating member 60 is positioned in a raised position. The base plate 51 of the adjusting plate 50 is in a plane with the base board 21 of the guiding member 20, the stopping portion 56 is inserted in the guiding slot 11, and the first spring 70 is in a nature state. The push bar 90 is received in the horizontal recess 241 with the inclined plane 922 resting against the guiding plane 52, and the second spring 80 is in a nature state. The guiding block 242 rests against a rear end of the sliding recess 911 for preventing the push bar 90 further going forward.

When the rotating member 60 is rotated downward, the bottom portion of the rear of the hinge portion 61 touches the front of the push bar 90 and pushes the push bar 90 to move rearward. The protrusion 921 of the push bar 90 gradually moves rearward out of the horizontal recess 241, meanwhile, the guiding block 242 slides in the sliding recess 911 and the second spring 80 is elongated and applies a pulling force on the push bar 90.

When the push bar 90 moves rearward under the action of the hinge portion 61 of the rotating member 60, the adjusting plate 50 is driven to rotate upward under the cooperation of the inclined plane 922 and the guiding plane 52. Meanwhile, the first spring 70 applies a force on the adjusting plate 50 for preventing the adjusting plate 50 excessively rotating. However, the force applied on the adjusting plate 50 by the push bar 90 is bigger than that of the first spring 70. So, the adjusting plate 50 can be driven to keep on rotating upward until the stopping portion 56 rests on a top of the protrusion 921, which prevents the adjusting plate 50 rotating downward under the force of the first spring 70.

When the resisting block 613 resists against the rear side of the vertical recess 25 to stop further pushing the push bar 90 rearward, the extending plate 63 is located in front of the base board 21 of the guiding member 20 and in a plane with the base board 21. In the meantime, the base plate 51 of the adjusting plate 50 is perpendicular to the base board 21 of the guiding member 20, and the stopping portion 56 just resists against the rear of the base portion 91 of the push bar 90, which increases a guiding area for the sheets to prevent the sheets skewing. If the user wants to reduce the guiding area of the sheets, the rotating members 60 are rotated upward. As the push bar 90 is not pushed by the hinge portion 61 any more, the pulling force of the second spring 80 pulls the push bar 90 forward. Then, the stopping portion 56 of the adjusting plate 50 slides off the protrusion 921 of the push bar 90 and the adjusting plate 50 rotates downward under the action of the first spring 70. Finally, the base plate 51 of the adjusting plate 50 is in a plane with the base board 21 again, and the stopping portion 56 is reinserted in the guiding slot 11.

As described above, when the rotating member 60 is rotated down, the rotating member 60 pushes the push bar 90 rearward. The push bar 90 squeezes the adjusting plate 50 and raises the adjusting plate 50 upward. As a result, the guiding area for the sheets is enlarged. The rotating member 60 also can be raised up. As the rotating member 60 does not push the push bar 90 any more, the push bar 90 moves forward to free the adjusting plate 50 so that the adjusting plate 50 rotates downward to be level with the base board 21. As a result, the size of the sheet guiding apparatus 100 is reduced. So, the adjusting plate 50 can be raised up to increase the guiding area, and also can be put down to reduce the size of the sheet guiding apparatus 100.

What is claimed is:

1. A sheet guiding apparatus assembled on a shelf, comprising:

a pair of guiding members movably mounted to two opposite ends of the shelf and capable of moving toward and away from each other to adjust a distance therebetween, the guiding member having a base board, a front portion of an outside edge of the base board extending upward to form a guiding portion, the guiding portion having a bottom thereof defining a horizontal recess extending along a front-to-rear direction to penetrate through the guiding portion, a hooking portion being protruded in a front of the horizontal recess;

a pair of adjusting plates each pivoted to a rear portion of the outside edge of the base board of one guiding member beside the guiding portion, the adjusting plate being capable of turning up and down;

a first spring mounted between the adjusting plate and the base board, the first spring applying a resetting force on the adjusting plate when the adjusting plate is turned up;

a pair of push bars movably received in the horizontal recesses of the guiding members respectively and capable of sliding in the respective horizontal recesses along the front-to-rear direction so as to drive the corresponding adjusting plates to rotate upward or free the corresponding adjusting plates therefrom;

a second spring having one end hooked to a front of the push bar and the other end fastened to the hooking portion, the second spring applying a pulling force on the push bar when the push bar is pushed rearward; and a pair of rotating members each pivoted to a front of the guiding portion of one guiding member and capable of turning up and down, when the rotating member is turned down, a rear of the rotating member touches a front end of the push bar and pushes the push bar to move rearward so that further drives the adjusting plate to rotate upward till being perpendicular to the base board.

2. The sheet guiding apparatus as claimed in claim 1, further comprising a gear and a pair of racks, the gear is assembled to a middle of a bottom of the shelf, the two racks have two opposite ends fastened to the guiding members respectively and other two ends engaged with two opposite sides of the gear, so that the distance between the guiding members are adjusted by means of the guiding members moving towards or away from each other under the drive of the racks and the gear.

3. The sheet guiding apparatus as claimed in claim 2, wherein the shelf defines a pair of guiding slots extending and aligned with each other along a direction perpendicular to the front-to-rear direction, each rack has the end thereof fastened to the guiding member protruded sideward to form a linking portion, the linking portion defines an opening, a pair of buckling portions is protruded in the opening from a side of the opening, a bottom of the base board extends downward to form a fixing portion with a pair of receiving openings, the fixing portion passes through the guiding slot to be inserted in the opening and the buckling portions are buckled with the receiving openings.

4. The sheet guiding apparatus as claimed in claim 1, wherein the rear portion of the outside edge of the base board is recessed inward to form a receiving space extending along the front-to-rear direction, a pair of through holes is opened at two opposite end sides of the receiving space and coaxially face to each other, a side edge of the adjusting plate protrudes sideward to form a pair of assembling parts each defining an assembling hole passing through the whole assembling part along the front-to-rear direction, the assembling holes face to each other and are coaxial with each other, the assembling parts are received in the receiving space by means of a shaft inserted through the through holes, the assembling holes and the first spring.

5. The sheet guiding apparatus as claimed in claim 4, wherein a first receiving hole is opened in an inside of the receiving space, a portion of the side edge of the adjusting plate between the two assembling parts is recessed inward to form a second receiving hole, the first spring is assembled between the assembling parts with one end fastened in the first receiving hole and the other end fastened in the second receiving hole.

6. The sheet guiding apparatus as claimed in claim 1, wherein a guiding block is protruded in the front of the horizontal recess, a lateral side of the push bar is recessed to form a sliding recess, the push bar moves in the horizontal recess by means of the guiding block slidably restrained in the sliding recess.

7. The sheet guiding apparatus as claimed in claim 1, wherein the front of the push bar defines a hooking hole for hooking the one end of the second spring therein.

8. The sheet guiding apparatus as claimed in claim 1, wherein a front end of the adjusting plate defines a guiding plane, a bottom of the adjusting plate near the guiding plane extends downward to form a stopping portion, a rear portion of the push bar has a lower portion thereof projected rearward to form a protrusion, a inclined plane is provided on a rear end of the protrusion and resists against the guiding plane, the inclined plane squeezes the guiding plane to drive the adjusting plate to rotate upward until the stopping portion rests on a top of the protrusion.

9. The sheet guiding apparatus as claimed in claim 1, wherein a front of an outside of the guiding portion defines a vertical recess with a bottom thereof connected with the front of the horizontal recess, a top portion of an inside of the vertical recess protrudes outward to form a hinge shaft, a rear portion of the rotating member defines a gap and a hinge hole located in front of the gap and communicating with the gap, the rotating member is pivoted to the front of the guiding portion by means of the hinge shaft passing through the gap to be pivoted in the hinge hole.

10. The sheet guiding apparatus as claimed in claim 1, wherein the rotating member has a handle and an extending plate extending sideward from a bottom thereof, the extending plate is in level with the base board when the handle is rotated down and pushes the push bar rearward to make the adjusting plate perpendicular to the base board of the guiding member.

* * * * *